US012325890B2

(12) United States Patent
Han et al.

(10) Patent No.: US 12,325,890 B2
(45) Date of Patent: Jun. 10, 2025

(54) ANNEALING SEPARATOR COMPOSITION FOR GRAIN-ORIENTED ELECTRICAL STEEL SHEET, GRAIN-ORIENTED ELECTRICAL STEEL SHEET, AND METHOD FOR MANUFACTURING GRAIN-ORIENTED ELECTRICAL STEEL SHEET

(71) Applicant: POSCO, Pohang-si (KR)

(72) Inventors: Min Soo Han, Pohang-si (KR); Yunsu Kim, Pohang-si (KR); Jong-Tae Park, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 963 days.

(21) Appl. No.: 17/414,777

(22) PCT Filed: Dec. 18, 2019

(86) PCT No.: PCT/KR2019/018030

§ 371 (c)(1),
(2) Date: Jun. 16, 2021

(87) PCT Pub. No.: WO2020/130643

PCT Pub. Date: Jun. 25, 2020

(65) Prior Publication Data

US 2022/0074011 A1 Mar. 10, 2022

(30) Foreign Application Priority Data

Dec. 19, 2018 (KR) ..... 10-2018-0165662

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
CPC ..... C22C 9/46
See application file for complete search history.

(56) References Cited

U.S. PATENT DOCUMENTS 5,509,976 A 4/1996 Yamazaki et al.
5,565,272 A * 10/1996 Masui ..... H01F 1/14783 148/309

(Continued)

FOREIGN PATENT DOCUMENTS

JP H05-287544 A 11/1993
JP H07-278827 A 10/1995

(Continued)

OTHER PUBLICATIONS

Written Opinion and International Search Report dated Apr. 10, 2020 issued in International Patent Application No. PCT/KR2019/018030 (with English translation).

(Continued)

*Primary Examiner* — Christopher S Kessler
(74) *Attorney, Agent, or Firm* — Morgan Lewis & Bockius LLP

(57) ABSTRACT

An oriented electrical steel sheet according to an embodiment of the present invention includes: a base texture; an AI permeation layer positioned on the base texture; and a film positioned on the AI permeation layer, wherein the AI permeation layer includes AI at 0.5 to 5 wt %, and the film includes an Al—Mg composite.

6 Claims, 6 Drawing Sheets

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/06*** | (2006.01) |

(52) U.S. Cl.
CPC ..... *C21D 8/0236* (2013.01); *C21D 8/1222* (2013.01); *C21D 8/1233* (2013.01); *C21D 8/1283* (2013.01); *C22C 38/002* (2013.01); *C22C 38/02* (2013.01); *C22C 38/06* (2013.01)

(56) References Cited

U.S. PATENT DOCUMENTS

| | | | | |
|---|---|---|---|---|
| 2003/0188806 | A1* | 10/2003 | Fujii | C21D 8/1283 148/112 |
| 2020/0095648 | A1* | 3/2020 | Han | C22C 38/06 |

FOREIGN PATENT DOCUMENTS

| | | | |
|---|---|---|---|
| JP | H11-158555 | A | 6/1999 |
| JP | 3895943 | B2 | 3/2007 |
| JP | 2014-201806 | A | 10/2014 |
| JP | 6191568 | B2 | 9/2017 |
| JP | 2020-511591 | A | 4/2020 |
| JP | 2020-511592 | A | 4/2020 |
| KR | 910018560 | A | 11/1991 |
| KR | 10-2004-0000302 | A | 1/2004 |
| KR | 10-2007-0086495 | A | 8/2007 |
| KR | 10-2013-0026243 | A | 3/2013 |
| KR | 10-2018-0072465 | A | 6/2018 |
| KR | 10-2018-0072487 | A | 6/2018 |
| KR | 10-2018-003295 | A | 7/2018 |
| KR | 10-2018-0073336 | A | 7/2018 |
| KR | 101909218 | B1 | 10/2018 |
| KR | 102174155 | B1 | 11/2020 |
| WO | 02/088403 | A1 | 11/2002 |
| WO | 2018/117637 | A1 | 6/2018 |
| WO | 2018/117638 | A1 | 6/2018 |

OTHER PUBLICATIONS

Notice of Allowance issued May 16, 2023 for counterpart Japanese Patent Application No. 2021-536315.

* cited by examiner

ANNEALING SEPARATOR COMPOSITION FOR GRAIN-ORIENTED ELECTRICAL STEEL SHEET, GRAIN-ORIENTED ELECTRICAL STEEL SHEET, AND METHOD FOR MANUFACTURING GRAIN-ORIENTED ELECTRICAL STEEL SHEET

TECHNICAL FIELD

The present disclosure relates to an annealing separating agent composition of an oriented electrical steel sheet, an oriented electrical steel sheet, and a manufacturing method of an oriented electrical steel sheet. More specifically, it relates to an annealing separating agent composition for an oriented electrical steel sheet, which improves a close contacting property and magnetism by adding a γ-oxide aluminum, an oriented electrical steel sheet, and a manufacturing method of an oriented electrical steel sheet.

CROSS-REFERENCE OF RELATED APPLICATIONS

This application is the U.S. National Phase under 35 U.S.C. § 371 of International Patent Application No. PCT/KR2019/018030, filed on Dec. 18, 2019, which in turn claims the benefit of Korean Application No. 10-2018-0165662, filed on Dec. 19, 2018, the entire disclosures of which applications are incorporated by reference herein.

BACKGROUND ART

An oriented electrical steel sheet has a texture in which an orientation of grains is in a {100}<001> direction by containing a Si component, and is an electrical steel sheet having an excellent magnetic characteristic in a rolling direction.

Recently, while an oriented electrical steel sheet of a high magnetic flux density has been commercially available, a material having small iron loss has been requested. In an electrical steel sheet, iron loss may be enhanced with four technical methods including a first method of accurately orienting a {110}<001> grain direction of a magnetic easy axis of an oriented electrical steel sheet in a rolling direction, a second method of forming a material in a thin thickness, a third method of minutely forming a magnetic domain through a chemical and physical method, and a fourth method of enhancing a surface property or imparting surface tension by a chemical method such as surface processing.

In particular, a method of forming a primary film and an insulating film for improving surface properties or imparting surface tension has been proposed. As the primary film, a layer of forsterite ($2MgO \cdot SiO_2$) formed by a reaction of silicon dioxide ($SiO_2$) generated in the process of a primary recrystallization annealing of an electrical steel sheet material and magnesium oxide (MgO) used as an annealing separating agent is known. In this way, the primary film formed during secondary recrystallization annealing must have a uniform color without defects in appearance, and functionally, it prevents fusion between plates in a coil state, and it is possible to bring about the effect of improving iron loss of the material by applying a tensile stress to the material due to a heat expansion coefficient difference between the material and the primary film.

However, currently, while a request for a low iron loss oriented electrical steel sheet increases, it is requested that the primary insulating film has high tension, and in fact, control techniques of various process factors have been attempted to improve the characteristics of the tensile film so that the high-strength insulating film may greatly improve the magnetic characteristics of the final product. If the film tension by the primary film is improved, not only the iron loss of the material but also transformer efficiency can be improved.

In contrast, a method for obtaining a high-tensile film by introducing a halogen compound into an annealing separating agent has been proposed. In addition, a technique for forming a mullite film with a low thermal expansion coefficient by applying an annealing separating agent, which is a major component of kaolinite, has been proposed. In addition, methods for strengthening an interface adherence by introducing rare elements such as Ce, La, Pr, Nd, Sc, and Y have been proposed. However, the annealing separating agent additive proposed by these methods is very expensive and has a problem that the workability is significantly inferior to be applied to the actual production process. Particularly, when a material such as kaolinite is manufactured as a slurry for use as the annealing separating agent, coating properties thereof are poor, and it is very insufficient as the annealing separating agent.

In addition, a method of adding aluminum oxide (α-oxide aluminum) or aluminum hydroxide to the annealing separating agent was proposed. However, in the case of aluminum oxide (α-oxide aluminum), a crystal phase change does not occur during the annealing after introduction into the annealing separating agent, so the improvement of the iron loss by reducing the thermal expansion coefficient may not be expected, and in the case of aluminum hydroxide, it is possible to expect a relatively high tensile primary film due to the formation of an Al—Mg—Si complex, but there is a drawback that it is very difficult to uniformly manufacture a powder particle size that controls the diffusion of aluminum hydroxide in order to create a complex reaction product, and accordingly it is not suitable to be applied to the actual mass production process.

DISCLOSURE

An annealing separating agent composition for an oriented electrical steel sheet, an oriented electrical steel sheet, and a manufacturing method for an oriented electrical steel sheet are provided.

More specifically, a γ-oxide aluminum is added to provide an annealing separating agent composition for an oriented electrical steel sheet, which improves a close contacting property and magnetism, an oriented electrical steel sheet, and a manufacturing method for an oriented electrical steel sheet.

An oriented electrical steel sheet according to an embodiment of the present invention includes: a base texture; an AI permeation layer positioned on the base texture; and a film positioned on the AI permeation layer.

The AI permeation layer includes AI at 0.5 to 5 wt %, and the film includes an Al—Mg composite.

The film may include 0.1 to 10 wt % of Al, 5 to 30 wt % of Mg, 0.1 to 20 wt % of Si, 10 to 55 wt % of O, and the balance of Fe.

The film may have a thickness of 0.1 to 10 μm.

The AI permeation layer may include α-oxide aluminum.

An occupied area of the α-oxide aluminum relative to the AI permeation layer area may be 0.1 to 50% with respect to the cross-section in the thickness direction of the steel sheet.

The AI permeation layer may have a thickness of 0.1 to 10 μm.

The base texture may include silicon (Si) at 2.0 to 7.0 wt %, aluminum (Al) at 0.020 to 0.040 wt %, manganese (Mn) at 0.01 to 0.20 wt %, phosphorus (P) at 0.01 to 0.15 wt %, carbon (C) at 0.01 wt % or less (excluding 0%), N at 0.005 to 0.05 wt %, and 0.01 to 0.15 wt % of antimony (Sb), tin (Sn), or a combination thereof, and the balance includes Fe and other inevitable impurities.

An annealing separating agent composition for an oriented electrical steel sheet according to an embodiment of the present invention includes 100 parts by weight of at least one of magnesium oxide and magnesium hydroxide; and 5 to 200 parts by weight of γ-oxide aluminum.

The γ-oxide aluminum may have an average particle size of 3 to 1000 nm.

1 to 10 parts by weight of a ceramic powder may be further included.

The ceramic powder may be one or more selected from $SiO_2$, $TiO_2$, and $ZrO_2$.

50 to 500 parts by weight of a solvent may be further included.

A manufacturing method of an oriented electrical steel sheet according to an embodiment of the present invention includes: preparing a steel slab; heating the steel slab; hot rolling the heated steel slab to manufacture a hot rolled plate; cold rolling the hot rolled plate to manufacture a cold-rolled sheet; primary-recrystallization annealing the cold-rolled sheet; coating an annealing separating agent on the surface of the primary recrystallization annealed steel sheet; and secondary-recrystallization annealing the steel sheet coated with the annealing separating agent, wherein the annealing separating agent includes 100 parts by weight of one or more of magnesium oxide and magnesium hydroxide and 5 to 200 parts by weight of γ-oxide aluminum.

According to an embodiment of the present invention, a large amount of AI penetrates into the base texture to form an AI permeation layer, thereby improving close contacting properties and magnetism between the film and the base texture.

MODE FOR INVENTION

Figure 1:
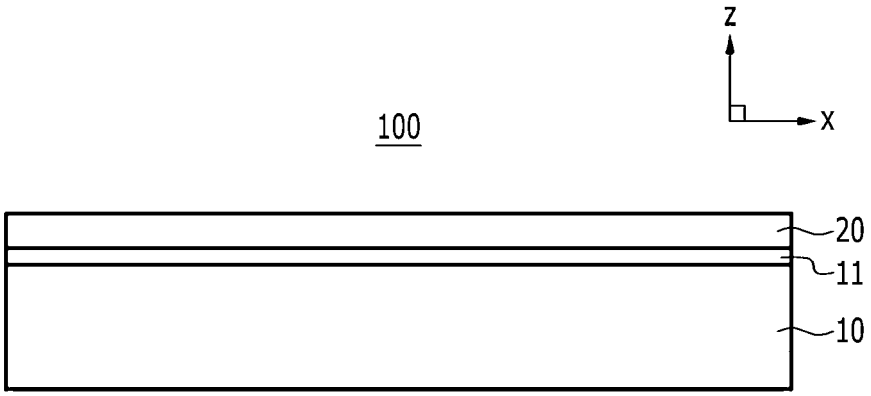
FIG. 1 is a side cross-sectional view schematically showing an oriented electrical steel sheet according to an embodiment of the present invention.

Terms used throughout the specification, such as 'first', 'second', 'third', etc., can be used to describe various portions, components, regions, layers, and/or sections, but are not limited thereto. These terms are used only to differentiate any portion, component, region, layer, or section from other portions, components, regions, layers, or sections. Therefore, a first portion, component, region, layer, section, and the like which are described below may be mentioned as a second portion, component, region, layer, section, and the like within a range without deviating from the scope of the present invention.

The terminologies used hereafter are only for describing specific embodiments and are not intended to limit the present invention. Singular terms used herein include plural terms unless phrases clearly express opposite meanings. The term 'including' used herein embodies concrete specific characteristics, regions, positive numbers, steps, operations, elements, and/or components, without limiting existence or addition of other specific characteristics, regions, positive numbers, steps, operations, elements, and/or components.

It will be understood that when an element such as a layer, film, region, or substrate is referred to as being "on" or "above" another element, it can be directly on or above the other element or intervening elements may also be present. In contrast, when an element is referred to as being "directly on" another element, there are no intervening elements therebetween.

Unless particularly mentioned, % refers to wt %, and 1 ppm is 0.0001 wt %.

In an embodiment of the present invention, further inclusion of an additional element means that an additional amount of the additional element is included in place of iron (Fe), which is a balance.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having meanings that are consistent with their meanings in the context of the relevant art, and will not be interpreted in an idealized or overly formal sense unless expressly so defined herein.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

The annealing separating agent composition for the oriented electrical steel sheet according to an embodiment of the present invention includes 100 parts by weight of one or more of magnesium oxide (MgO) and magnesium hydroxide Mg(OH) 2 and 5 to 200 parts by weight of γ (gamma)-oxide aluminum. Here, parts by weight means a weight included relative to each component.

In the annealing separating agent composition for the oriented electrical steel sheet according to an embodiment of the present invention, by adding aluminum oxide ($\gamma$-$Al_2O_3$) present in a form of γ phase crystals in addition to magnesium oxide (MgO), which is one of components of a conventional annealing separating agent composition, some react with the annealing separating agent to form a complex of Al—Mg, and some penetrate into the matrix texture, causing a phase change from the γ crystal phase to the α crystal phase, thereby improving the elastic coefficient of the film generated on the surface of the electrical steel sheet, which plays a role of ultimately reducing the iron loss of the material, thus it possible to manufacture a high efficiency transformer with less power loss.

In the manufacturing process of the oriented electrical steel sheet, when a cold-rolled sheet passes through a heating furnace controlled by a humid atmosphere for the primary recrystallization, Si, which has a highest oxygen affinity in the steel, reacts with oxygen supplied from the steam in the furnace to form $SiO_2$ on the surface. After that, oxygen permeates into the steel to produce Fe-based oxide. $SiO_2$ thus formed forms a forsterite ($Mg_2SiO_4$) layer through a chemical reaction as shown in Reaction Formula 1 below with magnesium oxide or magnesium hydroxide in the annealing separating agent.

$$2Mg(OH)_2+SiO_2 \rightarrow Mg_2SiO_4+2H_2O \quad \text{[Reaction Formula 1]}$$

That is, the electrical steel sheet that has undergone the primary recrystallization annealing undergoes secondary recrystallization annealing, that is, high temperature annealing, after applying magnesium oxide slurry as an annealing separating agent, and at this time, the material expanded by heat tries to shrink again when cooling, but a forsterite layer that is already created on the surface interferes with the shrinkage of the material. When a thermal expansion coefficient of the forsterite film is very small compared to the material, a residual stress □σRD in the rolling direction may be expressed as an equation below.

$$\sigma_{RD}=2E_c\delta(\alpha_{Si\text{-}Fe}-\alpha_c)\Delta T(1-v_{RD})$$

Here, it is represented that $\Delta T$=a difference of a secondary recrystallization annealing temperature and room temperature (° C.), $\alpha_{Si\text{-}Fe}$=a thermal expansion coefficient of a material, $\alpha_c$=a thermal expansion coefficient of a primary film, $E_c$= an average value of a primary film elastic (Young's Modulus)

$\delta$=a thickness ratio of a material and a coating layer, and $v_{RD}$=Poisson's ratio in a rolling direction.

From the equation, as a tensile stress improvement coefficient by the primary film, the thickness of the primary film or a difference in the thermal expansion coefficient between the base substrate and the film may be cited, and at this time, if the thickness of the film is improved, a space factor becomes poor, therefore the tensile stress may be increased by increasing the difference in the thermal expansion coefficient between the base substrate and the coating agent. However, since the annealing separating agent was limited to magnesium oxide, there are limitations in improving the film tension by increasing the difference in the thermal expansion coefficients or by increasing the film elastic (Young's Modulus) value.

In an embodiment of the present invention, in order to overcome the limitations of the physical properties of pure forsterite, by adding aluminum oxide ($\gamma$-$Al_2O_3$), which exists in the form of the $\gamma$-phase crystal when introducing an oxidized magnesium annealing separating agent, in addition to a pure forsterite film, an Al—Mg composite phase is formed, and some of them penetrate into the base texture to induce a phase change from $\gamma$ crystal phase to an $\alpha$ crystal phase, thereby lowering the thermal expansion coefficient and improving an elastic coefficient compared to the pure forsterite film.

As described above, the conventional film includes forsterite formed by the reaction of Mg—Si, and the thermal expansion coefficient is approximately 11×10-6/K, and the difference in thermal expansion coefficient with the base substrate does not exceed approximately 2.0. On the other hand, there is a spinel as an Al—Mg composite phase with a low thermal expansion coefficient, and the difference between the thermal expansion coefficient and the material is about 5.0. Furthermore, when the oxidized aluminum does not form the composite phase with Mg in the film and the phase change occurs from a pure $\gamma$ crystal phase to $\alpha$ crystal phase, the film elastic value (Young's Modulus) shows a value of 450 GPa or more compared to the normal forsterite, which is 200 GPa.

In an embodiment of the present invention, as described above, some of the aluminum-based additives introduced together with the annealing separating agent react with the annealing separating agent to form the composite of Al—Mg, thereby lowering the thermal expansion coefficient of the film and some penetrates into the base texture and causes a phase change from the $\gamma$ crystal phase to the $\alpha$ crystal phase, thereby improving the elastic coefficient of the film, ultimately improving the film tension.

Next, the annealing separating agent composition according to an embodiment of the present invention is described in detail for each component. In an embodiment of the present invention, the annealing separating agent composition includes100 parts by weight of one or more of magnesium oxide and magnesium hydroxide. In an embodiment of the present invention, the annealing separating agent composition may be present as a slurry type to be easily coated on the surface of the base substrate of the oriented electrical steel sheet. When water is included as a slurry's solvent, the magnesium oxide may be easily dissolved in water and may be present in a magnesium hydroxide form. Therefore, in an embodiment of the present Invention, magnesium oxide and magnesium hydroxide are handled as a single component. The meaning of increasing 100 parts by weight of one or more of magnesium oxide and magnesium hydroxide means to include 100 parts by weight of magnesium oxide when including magnesium oxide singly, to include 100 parts by weight of magnesium hydroxide when including magnesium hydroxide singly, and to include 100 parts by weight as a sum amount when simultaneously including magnesium oxide and magnesium hydroxide.

The activation degree of magnesium oxide may be 400 to 3000 seconds. If the activation of magnesium oxide is too large, a problem may occur with a spinel-based oxide ($MgO\cdot Al_2O_3$) on the surface after the secondary recrystallization annealing. When the activation of the magnesium oxide is too small, it may not be able to form the film because the oxide layer is not reacted.

Therefore, the activation of magnesium oxide may be adjusted to the range described above. At this time, the activation is the ability of a MgO powder capable of causing a chemical reaction with other components. The activation degree is measured as a time that is taken for MgO to completely neutralize a predetermined amount of citric acid solution. If the active degree is high, the time required for the neutralization is short, and if the active degree is low, the time required for the neutralization is long. Specifically, it is measured as the time required for that the solution is changed to pink in white when adding and stirring 2 g of MgO in a 0.4 N of citric acid solution 100 ml in which 2 ml of a 1% phenolphthalein reagent is added.

In an embodiment of the present invention, the annealing separating agent composition includes 5 to 200 parts by weight of $\gamma$-oxide aluminum ($\gamma$-$Al_2O_3$). $\gamma$-oxide aluminum differs from a general $\alpha$-oxide aluminum in terms of a crystal structure. In other words, v-oxide aluminum (Boehmite) has a ruby or spinel structure in terms of the crystal structure, whereas $\alpha$-oxide aluminum has a corundum structure as a high temperature stable structure, so there is a difference in the arrangement and position of AI/O atoms. Due to this difference in the crystal structure, $\alpha$-oxide aluminum has higher density and thermal conductivity than $\gamma$-oxide aluminum (Boehmite). In addition, in the case of γ-oxide aluminum (Boehmite), when sufficient energy is applied, the crystal structure tends to change into a more stable α-oxide aluminum.

After the first recrystallization annealing process, γ-oxide aluminum reacts with Si in the silica oxide layer formed on the material surface to form a Si—Al complex, and also reacts with magnesium oxide and magnesium hydroxide in the annealing separating agent to form a Mg—Al. complex. In addition, some γ-oxide aluminum penetrates into the base texture and undergoes a crystal phase change into α-oxide aluminum in a high temperature environment in the secondary recrystallization annealing process. This is because γ-oxide aluminum undergoes a phase transition from a γ phase to an α phase at about 1100° C.

On the other hand, when α-oxide aluminum rather than γ-oxide aluminum is added as an annealing separating agent, α-oxide aluminum has a complex oxide structure in which an atomic structure is complicated and stable, so there is little chemical reactivity with the surrounding oxide layer or magnesium oxide, and there is no concentration gradient in the thickness direction of the oxide layer. Due to this, it is difficult for α-oxide aluminum to penetrate the inside of the base texture, and it remains only in the film, therefore it is difficult to contribute to the improvement of close contacting properties and tension.

On the other hand, when an aluminum hydroxide other than γ-oxide aluminum is introduced as an annealing separating agent, there is a drawback that it is very difficult to uniformly manufacture a powder particle size that controls the diffusion of aluminum hydroxide, and due to this, it is very difficult to improve the close contacting properties and tension.

The γ-oxide aluminum is included at 5 to 200 parts by weight for 100 parts by weight of one or more of magnesium oxide and magnesium hydroxide. If too little γ-oxide aluminum is included, it is difficult to sufficiently obtain the effect of the addition of the γ-oxide aluminum described above. If too much γ-oxide aluminum is included, the applicability of the annealing separating agent composition may deteriorate. Therefore, γ-oxide aluminum may be included in the above-described range. More specifically, it may include 10 to 100 parts by weight of γ-oxide aluminum. More specifically, it may include aluminum hydroxide at 20 to 50 parts by weight.

The average particle size of γ-oxide aluminum may be 3 to 1000 nm. If the average particle size is too small, it is difficult to be manufactured, and when being introduced as an additive, a diffusion reaction occurs mainly into a silica oxide layer formed on the material surface, rather than improving the film tension due to the presence in the forsterite film, the purpose to be intended in the present invention may be achieved by making an Al—Si compound in the material. On the other hand, if the average particle size is too large, the film tension improvement effect may be remarkably deteriorated because the aluminum oxide does not exist in the forsterite film and mostly exists only on the surface. More specifically, it may be 3 to 50 nm.

The annealing separating agent composition for the oriented electrical steel sheet may further include 1 to 10 parts by weight of a ceramic powder per 100 parts by weight of at least one of magnesium oxide and magnesium hydroxide. The ceramic powder may be one or more selected from $SiO_2$, $TiO_2$, and $ZrO_2$. If an appropriate amount of the ceramic powder is further added, the insulating characteristic of the film may be further improved. Specifically, as the ceramic powder, it may further include $TiO_2$.

The annealing separating agent composition may further include a solvent for even dispersion and easy coating of solids. Water, alcohol, etc. may be used as the solvent, and 50 to 500 parts by weight may be included for 100 parts by weight of one or more of magnesium oxide and magnesium hydroxide. As such, the annealing separating agent composition may be in the form of a slurry.

The oriented electrical steel sheet 100 according to an embodiment of the present invention includes a base texture 10, an AI permeation layer 11 positioned on the base texture 10, and a film 20 positioned on the AI permeation layer 11. FIG. 1 is a side cross-sectional view schematically showing an oriented electrical steel sheet according to an embodiment of the present invention.

As described above, for the film 20 according to an embodiment of the present invention, an appropriate amount of magnesium oxide/hydroxide and ν-oxide aluminum is added in the annealing separating agent composition and undergoes secondary recrystallization annealing, and some γ-oxide aluminum penetrates inside the base texture 10 so as to cause the crystal phase change into α-oxide aluminum, while some reacts with Mg as the main component of the annealing separating agent, to form the Al—Mg complex such as spinel in the film 20. The phase change from γ oxide aluminum to a oxide aluminum increases the elastic coefficient of the AI permeation layer 11, and the Al—Mg composites such as the additionally generated spinel lowers the thermal expansion coefficient of the film 20, ultimately improving the film tension. Since this has been described above, a duplicate description is omitted.

In addition to the Al—Mg composite, the film may further include a Si—Mg composite and a Si—Al composite.

The film 20 may include 0.1 to 10 wt % of Al, 5 to 30 wt % of Mg, 0.1 to 20 wt % of Si, 10 to 55 wt % of O, and the balance of Fe. In the case of O, it may penetrate during the secondary recrystallization annealing. Other impurity components such as carbon (C) may be further included. In the film 20, an alloy component may have a concentration gradient according to the thickness, and the above-described content refers to an average content of the entire thickness in the film 20.

The film 20 may have a thickness of 0.1 to 10 μm. If the thickness of the film 20 is too thin, the ability to impart the film tension is deteriorated, which may lead to heat loss problems. If the thickness of film 20 is too thick, the close contacting property of the film 20 is deteriorated and delamination may occur. Therefore, the thickness of the film 20 may be adjusted within the above-described range. More specifically, the thickness of the film 20 may be 0.8 to 6 μm. The film 20 is a part including less than 90 wt % of Fe, and is distinguished from the AI permeation layer 11 and the base texture 10 including more than 90 wt % of Fe.

As shown in FIG. 1, the AI permeation layer 11 may be formed from the interface of the film 20 and the base texture 10 into the interior of the base texture 10. The AI permeation layer 11 is a layer including 0.5 to 5 wt % AI and is distinguished from the base texture 10 including less Al.

As described above, in an embodiment of the present invention, by adding γ-oxide aluminum to the annealing separating agent composition, some penetrates into the base texture 10 and undergoes the secondary recrystallization annealing process, thereby causing the crystal phase changes into α-oxide aluminum in the AI permeation layer 11. Through such a phase change of γ→ a oxide aluminum, the elastic coefficient is higher than that of the conventional forsterite film, and thus, it shows an excellent film tension compared to the conventional one. More specifically, with respect to the cross-section in the thickness direction of the steel sheet, the occupied area of α-oxide aluminum for the AI permeation layer 11 area may be 0.1 to 50%. The cross-section in the thickness direction means a cross-section (an ND-RD surface, an ND-TD surface) including the thickness direction (an ND direction).

In addition, some of the γ-oxide aluminum introduced in the annealing separating agent composition forms an Al—Mg composite such as spinel in the film 20. The Al—Mg composite such as spinel has a lower thermal expansion coefficient than the material or the conventional forsterite film and also improves the adherence of the base texture 10 and the film 20, thereby improving the tension by the film 20. Since the Al—Mg composite has been described above, redundant description is omitted.

In an embodiment of the present invention, the effect of the annealing separating agent composition and the film 20 appears regardless of the composition of the base texture 10 of the oriented electrical steel sheet. In addition, the components of the base texture 10 of the oriented electrical steel sheet are described as follows.

The base texture 10 of the oriented electrical steel sheet includes 2.0 to 7.0 wt % of silicon (Si), 0.020 to 0.040 wt % of aluminum (AI), 0.01 to 0.20 wt % of manganese (Mn), 0.01 to 0.15 wt % of phosphorus (P), 0.01 wt % or less (excluding 0%) of carbon (C), 0.005 to 0.05 wt % of N, and 0.01 to 0.15 wt % of antimony (Sb), Tin (Sn), or a combination thereof, and the balance may include Fe and other inevitable impurities. Since the description of each component of the base texture 10 of the oriented electrical steel sheet is the same as generally known information, the detailed descriptions are omitted.

The manufacturing method of the oriented electrical steel sheet according to an embodiment of the present invention includes: preparing a steel slab; heating the steel slab; hot-rolling the heated steel slab to manufacture a hot rolled plate; cold-rolling the hot rolled plate to manufacture a cold rolled plate; primary-recrystallization annealing the cold-rolled sheet; coating an annealing separating agent on the surface of the steel sheet subjected to the primary recrystallization annealing; and secondary-recrystallization annealing the steel sheet to which the annealing separating agent is coated. In addition, the manufacturing method of the oriented electrical steel sheet may further include other steps.

First, the steel slab is prepared.

Next, the steel slab is heated. At this time, the slab heating may be performed by a low temperature slab method below 1200° C.

Next, the heated steel slab is hot-rolled to manufacture the hot rolled plate. Thereafter, the manufactured hot-rolled plate may be subject to hot rolled annealing.

Next, the hot-rolled plate is cold-rolled to manufacture a cold-rolled plate. In the step of manufacturing the cold-rolled sheet, cold rolling may be performed once, or two or more cold rollings including intermediate annealing may be performed.

Next, the cold-rolled sheet is subjected to a primary recrystallization annealing. The first recrystallization annealing process may simultaneously include decarburization annealing and nitriding annealing of the cold-rolled sheet, or may include nitriding annealing after the decarburization annealing. Next, an annealing separating agent is coated on the surface of the steel sheet subjected to the primary recrystallization annealing. Since the annealing separating agent has been described above in detail, a repeated description is omitted.

The coated amount of the annealing separating agent may be 6 to 20 g/m$^2$. If the coated amount of the annealing separating agent is too small, the film may not be formed smoothly. Too great an applied amount of the annealing separating agent may affect the secondary recrystallization. Therefore, the coated amount of the annealing separating agent may be adjusted within the above-described range.

After coating the annealing separating agent, it may further include a step of drying.

The drying temperature may be 300 to 700° C. If the temperature is too low, the annealing separating agent may not be dried easily. If the temperature is too high, it may affect the secondary recrystallization. Therefore, the drying temperature of the annealing separating agent may be adjusted within the above-described range.

Next, the secondary recrystallization annealing is performed on the steel sheet coated with the annealing separating agent. During the secondary recrystallization annealing, a film 20 including a Mg—Si forsterite, α-oxide aluminum, and Al—Mg composites such as spinel is formed on the outermost surface by the annealing separating agent component and silica reaction. In addition, oxygen and aluminum penetrate into the base substrate 10, forming an AI permeation layer 11.

The secondary recrystallization annealing may be performed at a heating speed of 18 to 75° C./h in the temperature range of 700 to 950° C., and a heating speed of 10 to 15° C./h in the temperature range of 950 to 1200° C. The film 20 may be formed smoothly by controlling the heating speed in the above range. In addition, the heating process at 700 to 1200° C. may be carried out in an atmosphere including 20 to 30 volume % of nitrogen and 70 to 80 volume % of hydrogen, and after reaching 1200° C., it may be carried out in an atmosphere including 100 volume % of hydrogen. The film 20 may be formed smoothly by controlling the atmosphere in the above range.

Hereinafter, the present invention is described in more detail through embodiments. However, these embodiments are only for exemplifying the present invention, and the present invention is not limited thereto.

AN EMBODIMENT

A steel slab including Si at 0.04%, Sb at 0.03%, and P at 0.03% by wt %, and Fe and inevitable impurities in the balance was prepared.

The slab was heated at 1150° C. for 220 minutes and then hot-rolled to a thickness of 2.8 mm to prepare a hot-rolled plate.

The hot rolled plate was heated to 1120° C., maintained at 920° C. for 95 seconds, quenched in water, pickled, and then cold-rolled to a thickness of 0.23 mm to prepare a cold-rolled plate.

After the cold-rolled sheet was put into a furnace maintained at 875° C., it was simultaneously decarburized and nitrified by maintaining it in a mixed atmosphere of 74 volume % of hydrogen, 25 volume % of nitrogen, and 1 volume % of dried ammonia gas for 180 seconds.

As an annealing separating agent composition, an annealing separating agent prepared by mixing 250 g of water in a solid mixture consisting of 100 g of magnesium oxide with an activation degree of 500 seconds, an amount as listed in Table 1 below of γ-oxide aluminum, and 2.5 g of titanium oxide was prepared. The annealing separating agent 10 g/m$^2$ was coated, and the secondary recrystallization annealing was performed in a coil shape. During the secondary recrystallization annealing, a soaking temperature was 700° C. and a secondary soaking temperature was 1200° C., and a heating condition in a heating section was 45° C./h in the temperature section of 700 to 950° C. and was 15° C./h in the temperature section of 950 to 1200° C. On the other hand, a soaking time at 1200° C. was 15 hours. The atmosphere during the secondary recrystallization annealing was a mixed atmosphere of 25 volume % of nitrogen and 75 volume % of hydrogen up to 1200° C., and after reaching 1200° C., it was kept in a 100 volume % hydrogen atmosphere and then the furnace was cooled.

Table 1 summarizes the components of the annealing separating agent applied to the present invention. Table 2 below summarizes a tension, close contacting property, an iron loss, a magnetic flux density, and an iron loss improvement rate after the secondary recrystallization annealing after coating the annealing separating agent prepared as shown in Table 1 to a specimen.

In addition, the film tension is obtained by measuring a curvature radius (H) of the specimen generated after removing the coating on one side of the double-sided coated specimen and substituting the measured value into the equation below.

$$\delta_{Exp} = \frac{E_c}{1 - v_{RD}} \times \frac{T^2}{3t} \times \frac{2H}{l^2}$$

$E_c$=a primary film elastic (Young's Modulus) average $v_{RD}$=Poisson's ratio in a rolling direction T: a thickness before coating t: a thickness after coating I: a specimen length H: a curvature radius In addition, the close contacting property is expressed by a minimum circular arc diameter without a film peeling when the specimen is bent 180° in contact with a 10 to 100 mm circular arc.

The iron loss and magnetic flux density were measured using a single sheet measurement method, and the iron loss (W17/50) refers to a power loss that occurs when a magnetic field with a frequency of 50 Hz is magnetized with AC up to 1.7 Tesla. The magnetic flux density B8 represents a magnetic flux density value flowing through an electrical steel sheet when a current of 800 A/m size is passed through a winding wound around the electrical steel sheet.

The iron loss improvement rate was calculated as ((comparative example iron loss-embodiment iron loss)/comparative example iron loss)×100 based on comparative example using a MgO annealing separating agent.

TABLE 1

| Specimen | Magnesium oxide | γ-oxide aluminum | | α-oxide aluminum | Titanium oxide | Pure water | |
|---|---|---|---|---|---|---|---|
| No. | (g) | (g) | (nm) | (g) | (g) | (g) | |
| 1 | 100 | — | — | 50 | 2.5 | 250 | Comparative Example 1 |
| 2 | 100 | — | — | 200 | 2.5 | 250 | Comparative Example 2 |
| 3 | 100 | 3 | 3 | — | 2.5 | 250 | Comparative Example 3 |
| 4 | 100 | 40 | 3 | — | 2.5 | 250 | Embodiment 1 |
| 5 | 100 | 100 | 3 | — | 2.5 | 250 | Embodiment 2 |
| 6 | 100 | 250 | 3 | — | 2.5 | 250 | Embodiment 3 |
| 7 | 100 | 3 | 20 | — | 2.5 | 250 | Comparative Example 4 |
| 8 | 100 | 40 | 20 | — | 2.5 | 250 | Embodiment 4 |
| 9 | 100 | 100 | 20 | — | 2.5 | 250 | Embodiment 5 |
| 10 | 100 | 250 | 20 | — | 2.5 | 250 | Embodiment 6 |
| 11 | 100 | 3 | 1500 | — | 2.5 | 250 | Comparative Example 5 |
| 12 | 100 | 40 | 1500 | — | 2.5 | 250 | Embodiment 7 |
| 13 | 100 | 100 | 1500 | — | 2.5 | 250 | Embodiment 8 |
| 14 | 100 | 250 | 1500 | — | 2.5 | 250 | Embodiment 9 |
| 15 | 100 | — | — | aluminum hydroxide 100 g | 2.5 | 250 | Comparative Example 6 |
| 16 | 100 | — | — | — | 2.5 | 250 | Comparative Example 7 |

TABLE 2

| Specimen No. | Film tension (kgf/mm$^2$) | Close contacting property (mm □) | Al content in Al permeation layer (wt %) | $Al_2O_3$ occupied area in Al permeation layer (%) | Magnetic property Iron loss (W17/50 | Improvement rate (%) | Magnetic flux density B8 | |
|---|---|---|---|---|---|---|---|---|
| 1 | 0.41 | 25 | — | — | 0.93 | 3.1 | 1.91 | Comparative example 1 |
| 2 | 0.43 | 25 | — | — | 0.94 | 2.1 | 1.91 | Comparative example 2 |
| 3 | 0.46 | 25 | 0.4 | 0.89 | 0.93 | 3.1 | 1.91 | Comparative example 3 |
| 4 | 1.03 | 20 | 4.3 | 8.9 | 0.84 | 12.5 | 1.93 | embodiment 1 |
| 5 | 0.85 | 20 | 4.7 | 9.3 | 0.86 | 10.4 | 1.94 | embodiment 2 |
| 6 | 0.9 | 15 | 4.9 | 9.5 | 0.85 | 11.5 | 1.93 | embodiment 3 |
| 7 | 0.45 | 20 | 0.1 | 0.22 | 0.94 | 2.1 | 1.92 | Comparative example 4 |
| 8 | 1.01 | 15 | 4.2 | 8.2 | 0.82 | 14.6 | 1.94 | embodiment 4 |
| 9 | 0.98 | 15 | 4.3 | 8.7 | 0.81 | 15.6 | 1.94 | embodiment 5 |
| 10 | 0.43 | 25 | 3.7 | 2.9 | 0.93 | 3.1 | 1.91 | embodiment 6 |
| 11 | 0.45 | 25 | 0.05 | 0.09 | 0.94 | 2.1 | 1.92 | Comparative example 5 |
| 12 | 0.42 | 25 | 0.2 | 0.38 | 0.96 | 0 | 1.92 | embodiment 7 |
| 13 | 0.38 | 25 | 0.2 | 0.33 | 0.94 | 2.1 | 1.92 | embodiment 8 |
| 14 | 0.41 | 25 | 0.3 | 0.45 | 0.94 | 2.1 | 1.92 | embodiment 9 |
| 15 | 0.52 | 25 | 0.4 | 0.59 | 0.93 | 3.1 | 1.92 | Comparative example 6 |
| 16 | 0.39 | 25 | — | — | 0.96 | — | 1.91 | Comparative example 7 |

As shown in Table 1 and Table 2, when γ-oxide aluminum is used as an annealing separating agent, it may be confirmed that the film tension, the close contacting properties, and the magnetic properties are improved compared to when α-oxide aluminum is used. It may be confirmed that this is due to the Al content in the AI permeation layer and the area occupied by $Al_2O_3$.

Figure 2:
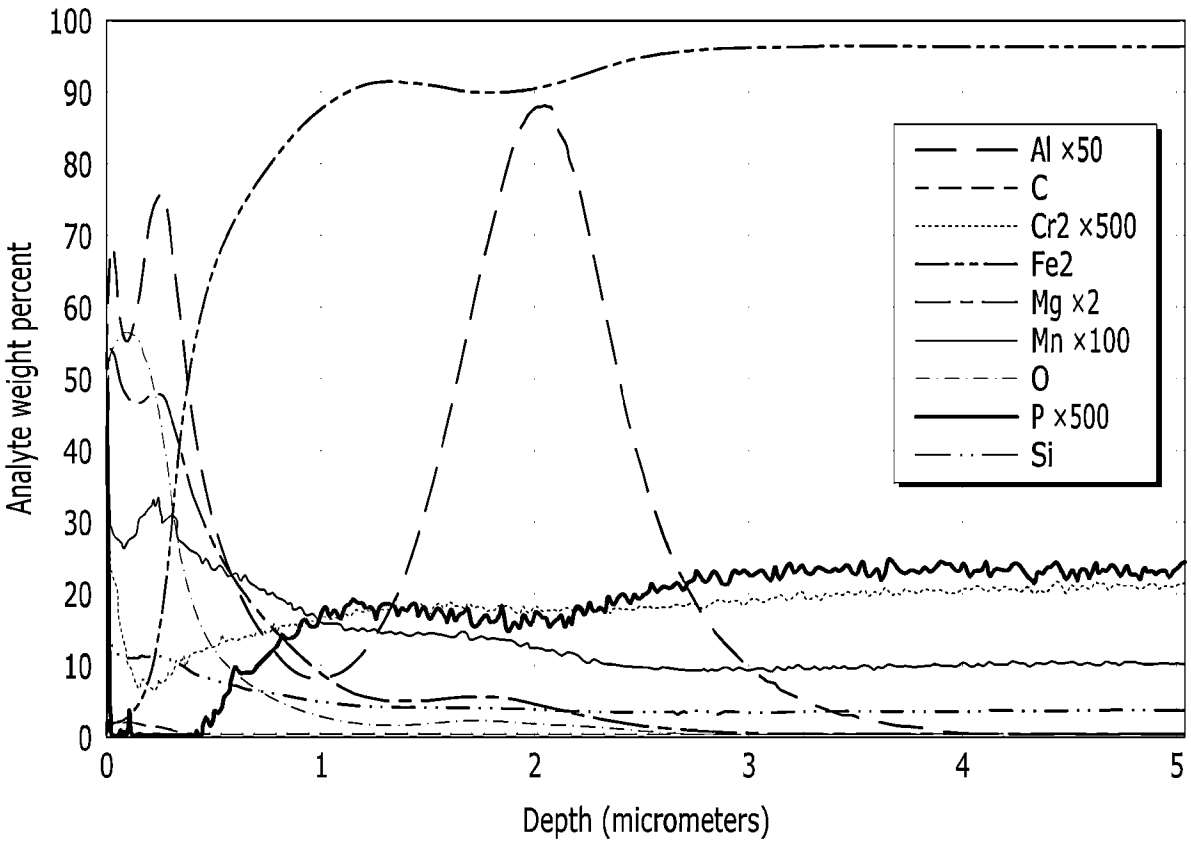
FIG. 2 is a view showing a GDS analysis result of an oriented electrical steel sheet manufactured in an Embodiment 4.
Figure 3:
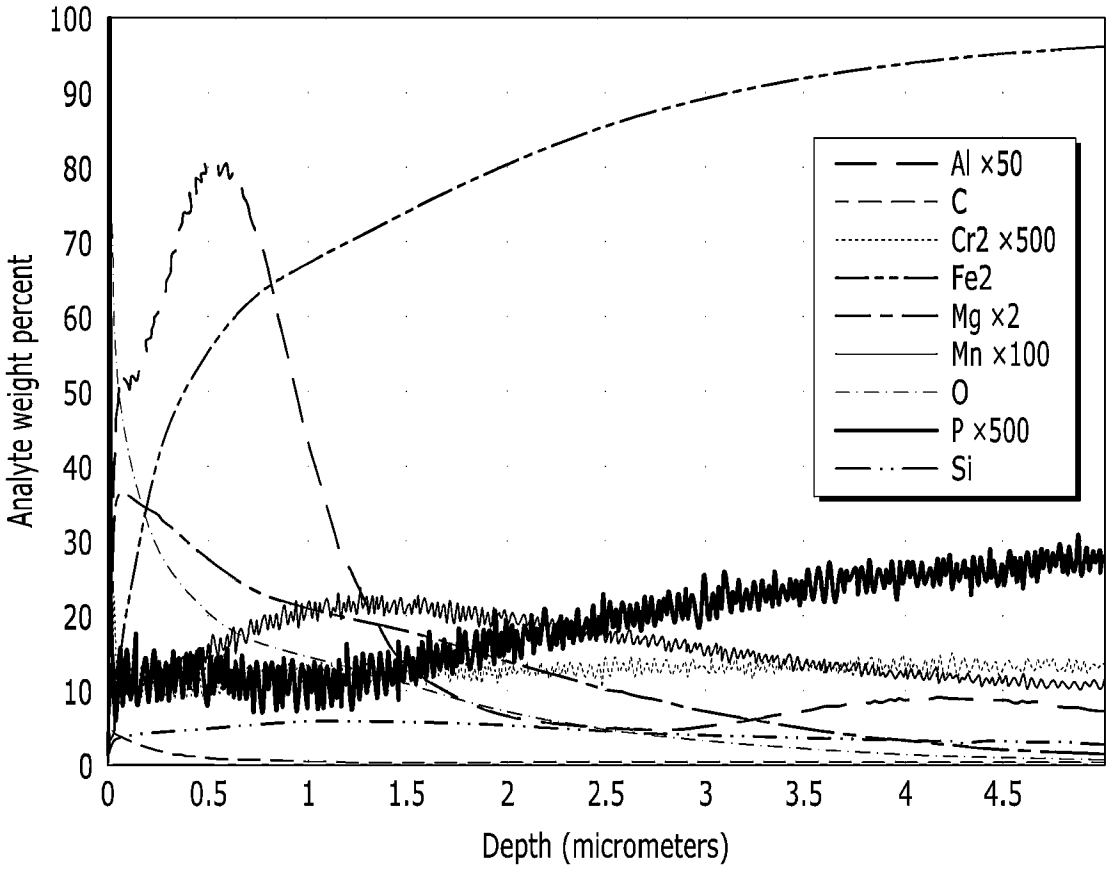
FIG. 3 is a view showing a GDS analysis result of an oriented electrical steel sheet manufactured in a Comparative Example 2.

FIG. 2 and FIG. 3 show results of a GDS analysis for an oriented electrical steel sheet manufactured in Embodiment 4 and Comparative Example 2. It may be confirmed that a large number of AI was detected in the Al permeation layer (1 to 3 μm thickness range) in Embodiment 4, but relatively little AI was detected in the lower portion of the film (range over 3 μm) in Comparative Example 2.

Figure 4:
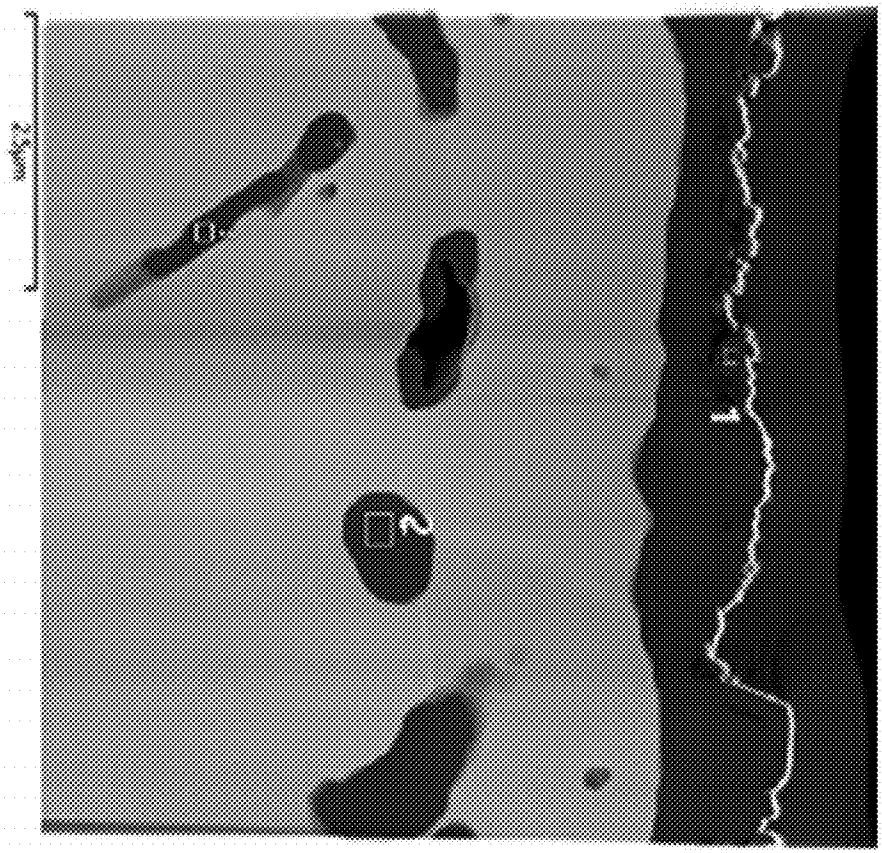
FIG. 4 is a view showing a focused ion beam-scanning electron microscope (FIB-SEM) analysis result of an oriented electrical steel sheet manufactured in an Embodiment 4.
Figure 5:
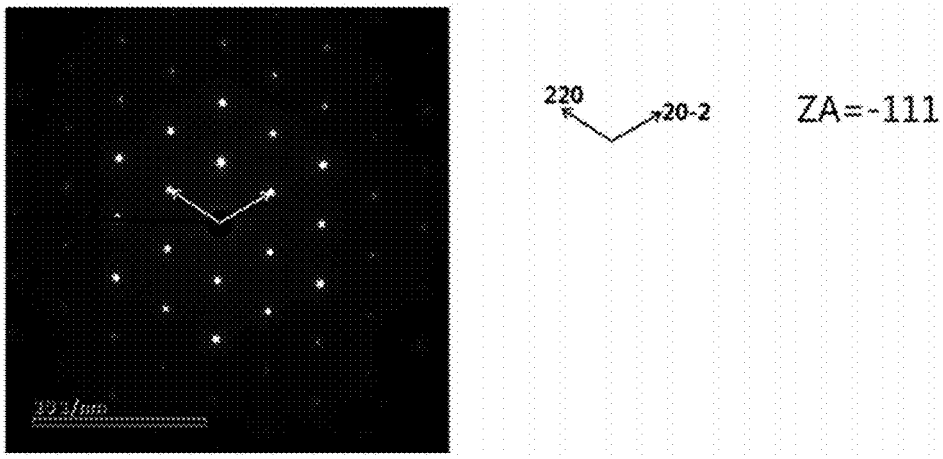
FIG. 5 is a view showing an analysis result of an aluminum-magnesium composite phase crystal ($Al_2MgO_4$, FCC) for 1 of FIG. 4.
Figure 6:
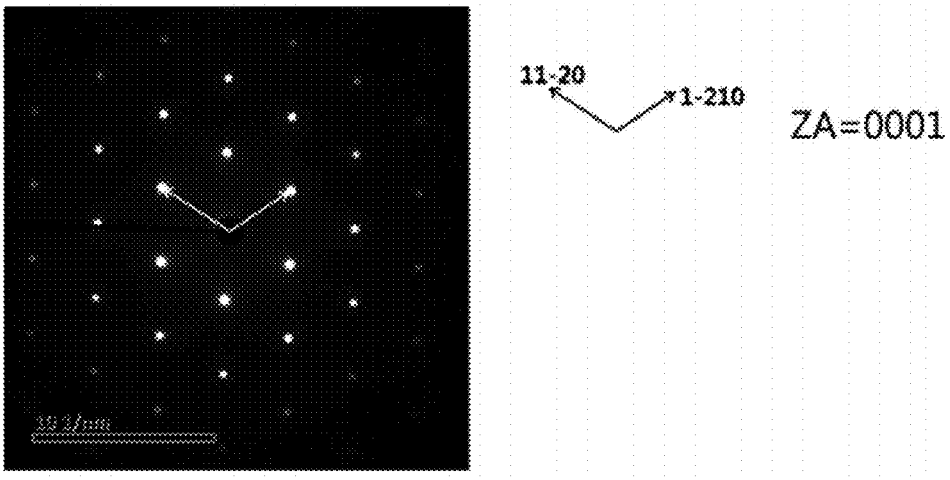
FIG. 6 is a view showing an analysis result of an α-aluminum (rhombohedral) crystal for 2 of FIG. 4.

FIG. 4 is a result of a focused ion beam-scanning electron microscope (FIB-SEM) analysis of an oriented electrical steel sheet manufactured in Embodiment 4. As shown in FIG. 5, in 1 (the film) of FIG. 4, a spinel of an Al—Mg composite was detected. As shown in FIG. 6, in 2 of FIG. 4 (an Al permeation layer), α-oxide aluminum was detected.

The present invention is not limited to the embodiments, but may be manufactured in a variety of different forms, and those of ordinary skill in the art to which the present invention pertains to other specific forms without changing the technical spirit or essential features of the present invention. Therefore, it should be understood that the embodiments described above are illustrative and non-limiting in all respects.

DESCRIPTION OF SYMBOLS

100: oriented electrical steel sheet 10: base texture 11: AI permeation layer 20: film

The invention claimed is:

1. An oriented electrical steel sheet comprising:
a base texture;
an AI permeation layer positioned on the base texture; and
a film positioned on the AI permeation layer,
wherein the AI permeation layer includes AI at 0.5 to 5 wt %, and
the film includes an Al—Mg composite, and
the film consists of 0.1 to 10 wt % of Al, 5 to 30 wt % of Mg, 0.1 to 20 wt % of Si, 10 to 55 wt % of O, and the balance of Fe.

2. The oriented electrical steel sheet of claim 1, wherein the film has a thickness of 0.1 to 10 μm.

3. The oriented electrical steel sheet of claim 1, wherein the AI permeation layer includes α-oxide aluminum.

4. The oriented electrical steel sheet of claim 3, wherein an occupied area of the α-oxide aluminum relative to the AI permeation layer area is 0.1 to 50% with respect to the cross-section in the thickness direction of the steel sheet.

5. The oriented electrical steel sheet of claim 1, wherein the AI permeation layer has a thickness of 0.1 to 10 μm.

6. The oriented electrical steel sheet of claim 1, wherein the base texture includes silicon (Si) at 2.0 to 7.0 wt %, aluminum (Al) at 0.020 to 0.040 wt %, manganese (Mn) at 0.01 to 0.20 wt %, phosphorus (P) at 0.01 to 0.15 wt %, carbon (C) at 0.01 wt % or less (excluding 0%), N at 0.005 to 0.05 wt %, and 0.01 to 0.15 wt % of antimony (Sb), tin (Sn), or a combination thereof, and the balance includes Fe and other inevitable impurities.

* * * * *